United States Patent [19]

Watson et al.

[11] 3,944,104

[45] Mar. 16, 1976

[54] THREADED WINE BOTTLE STOPPER

[75] Inventors: William Bruce Watson; Vernon James Graves, both of Toronto, Canada

[73] Assignee: Consumers Glass Company Limited, Toronto, Canada

[22] Filed: Nov. 25, 1974

[21] Appl. No.: 526,901

[52] U.S. Cl. ..... 215/307

[51] Int. Cl.[2] ..... B65D 51/16

[58] Field of Search ..... 215/262, 270, 271, 307, 215/329, 354, 261, 344; 220/303, 360, 374, 373, 367, 366

[56] References Cited

UNITED STATES PATENTS

| | | | |
|---|---|---|---|
| 3,010,596 | 11/1961 | Williams | 215/307 X |
| 3,074,579 | 1/1963 | Miller | 215/344 |
| 3,100,577 | 8/1963 | Miller | 215/261 |
| 3,147,876 | 9/1964 | Lepore | 215/329 X |
| 3,164,279 | 1/1965 | Towns | 215/307 X |
| 3,844,439 | 10/1974 | Demers | 215/344 |

FOREIGN PATENTS OR APPLICATIONS

| | | | |
|---|---|---|---|
| 1,155,406 | 11/1957 | France | 215/261 |

*Primary Examiner*—Donald F. Norton

[57] ABSTRACT

A threaded bottle stopper for controlling the release of pressurized gases from a bottle is disclosed. The threaded bottle stopper is used in conjunction with an externally threaded bottle neck and comprises a cap having an internally threaded annular skirt depending downwardly therefrom and a tubular body portion extending downwardly from and integral with the underside of the cap. The outside diameter of the tubular body portion is such to permit insertion thereof within a neck bore of a bottle. The continuous thread on the annular skirt engages a continuous thread on the neck of the bottle where rotation of the threaded stopper in both directions moves the tubular body portion respectively into and out of the neck bore of the bottle. The bottle stopper is provided with means for sealing the discharge opening of the bottle neck. The tubular body portion of the stopper has gas release means on the outside surface thereof for controlling the release of pressurized gases from the bottle by providing at least one open-ended tortuous channel through which the pressurized gases pass before escaping to the atmosphere. The gas release means releases pressurized gases from the bottle while the threaded stopper engages the threaded bottle neck. The threaded bottle stopper provides a mechanical means for removing a stopper from a bottle containing carbonated beverages where the release of pressurized gases is controlled to preclude spillage and ejection of the stopper at a high velocity when the bottle is opened.

17 Claims, 5 Drawing Figures

THREADED WINE BOTTLE STOPPER

FIELD OF INVENTION

This invention relates to a threaded bottle stopper for wine bottles and the like having mechanical means to assist in the removal of the stopper from the bottle and simultaneously control the release of pressurized gases from the bottle to preclude both ejection of the stopper at a dangerous velocity and spillage of the contents.

BACKGROUND OF THE INVENTION

With the known types of plastic and cork bottle stoppers for bottles containing carbonated wines and the like, a problem exists in the removal of the stopper from the bottle neck either too readily or, in some instances, the stopper is so tightly held in the bottle neck that removal of the stopper is very difficult. The inability of mechanical glass blowing machines to hold close tolerances for the neck bore dimension of the bottle is usually the cause of this problem. Where the cork or plastic stopper is held in the neck bore of a bottle by a conventional wire cage, removal of the cage can result in the stopper being ejected from the bottle at a dangerous velocity causing bodily injury and/or property damage. The velocity at which the stopper is ejected is dependent upon the degree of compression of the stopper in the neck bore and the type of bottled carbonated beverage.

The threaded bottle stopper according to this invention overcomes the above problems by providing a stopper which has a mechanical assist for overcoming the frictional fit of the stopper in the neck bore to assist in removing the stopper and simultaneously control the release of pressurized gases from the bottle to reduce the possibility of the stopper being ejected from the bottle at a dangerous velocity. The threaded bottle stopper may be made from a thermoplastic resin having the desired memory to permit a compression fit of the stopper in the neck bore of the bottle. The threaded bottle stopper comprises a cap having a disc portion with an annular skirt depending downwardly therefrom. A tubular body portion extends downwardly from and integral with the underside of the disc portion. A continuous thread is provided on the inside surface of the annular skirt. The outside diameter of the tubular body portion is of a dimension which permits insertion thereof within the neck bore of a bottle. The continuous thread on the annular skirt engages a continuous thread on the neck of the bottle so that rotation of the threaded bottle stopper about its longitudinal axis in either direction, moves the tubular body portion respectively into and out of the neck bore of the bottle. The bottle stopper has means for sealing the discharge opening of the bottle neck.

The tubular body portion of the threaded bottle stopper has gas release means provided on the outside surface thereof for controlling the release of pressurized gases from the bottle. The gas release means comprises at least one open-ended tortuous channel through which the pressurized gases pass before escaping to the atmosphere. The gas release means is operable to release pressurized gases from the bottle while the continuous thread on the annular skirt remains in engagement with the external thread of the externally threaded bottle neck. The release of the gas is, of course, subsequent to the breaking of the sealing means which is caused by rotation of the threaded bottle stopper in the respective direction to withdraw the tubular body portion from the neck bore of the bottle.

The gas release means may consist of a single spiral thread provided on the outside surface of the tubular body portion. The thickness of the thread ridge is such to permit sliding contact between the thread ridge and the inside surface of the neck bore of the bottle. The single spiral thread is shaped to define an open-ended spiral-shaped channel.

The open-ended tortuous channel is so positioned on the outside surface of the tubular body portion that communication of the channel with the atmosphere is complete prior to disengagement of the continuous thread on the inside surface of the annular skirt with the threaded neck portion of the bottle so that the release of the pressurized gases cannot eject the stopper from the bottle at a dangerous velocity.

The release of the pressurized gases from the bottle is controlled by a preselected cross-sectional area for the open-ended channel to ensure that a portion of the pressurized gases remain in the bottle a short time after the initial release of gases from the bottle so that a complete removal of the bottle stopper from the bottle neck results in the familiar and very desirable "pop" sound thereby indicating to the consumer that the contents are fit for consumption.

Since the threaded bottle stopper provides a mechanical assist for withdrawing the tubular body portion from the neck bore of a wine bottle, the bottle stopper may be slightly oversized to ensure that the neck bore is properly sealed thereby alleviating the need to closely control the neck bore tolerances of glass blown bottles.

SUMMARY OF THE INVENTION

It is therefore an object of the present invention to provide a threaded bottle stopper which has a mechanical assist for overcoming the frictional engagement of the bottle stopper in a bottle neck bore to assist in the withdrawal of the bottle stopper from the bottle.

It is another object of the invention to provide a threaded bottle stopper which reduces the hazard of the bottle stopper being ejected from the bottle at a dangerous velocity to cause either bodily injury or property damage and also reduce the possibility of spillage of the contents during opening of the bottle.

It is a further object of the invention to provide a threaded bottle stopper which controls the release of pressurized gases from within a bottle to the atmosphere so that when the bottle stopper is completely withdrawn from the neck bore of a bottle, the familiar "pop" sound is heard.

BRIEF DESCRIPTION OF THE DRAWINGS

These and other objects, advantages and features of the present invention will become apparent in the following detailed description of the invention as it is shown in the drawings wherein.

DETAILED DESCRIPTION OF THE PREFERRED EMBODIMENTS

Figure 1:
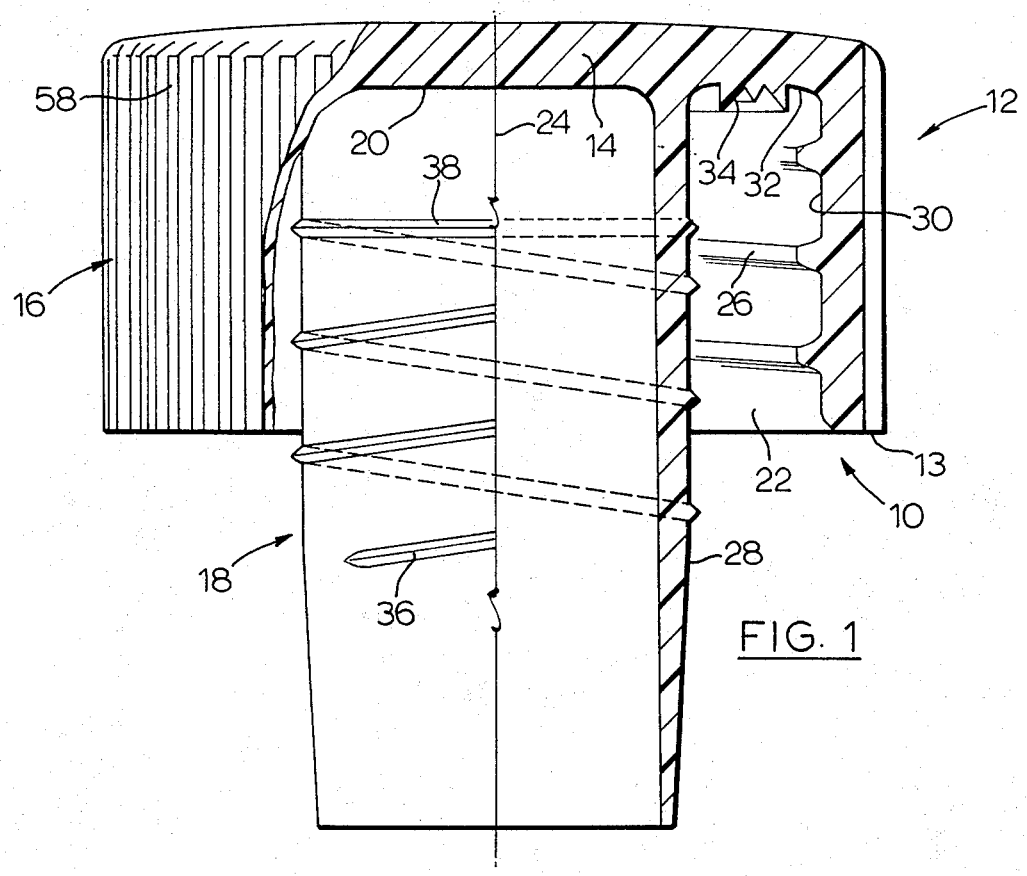
FIG. 1 is a partially sectioned side view of the threaded bottle stopper according to a preferred embodiment of the invention.

A threaded bottle stopper according to a preferred embodiment of the invention is generally designated as 10 in FIG. 1 and comprises a cap generally designated as 12 having a disc portion 14 with an annular skirt depending downwardly therefrom. The annular skirt 16 is integral with the disc portion 14 and meets the disc portion at the periphery thereof. A tubular body portion generally designated as 18 extends downwardly from the underside 20 of the disc portion 14. The overall outside diameter of the tubular body portion 18 is less than the overall inside diameter of annular skirt 16 so that an annular space 22 is defined between the outside surface of the tubular body portion 18 and the inside surface of the annular skirt 16. The tubular body portion 18 is molded integrally with the underside 20 of the disc portion 14 in the manner shown in the drawing. The longitudinal axis 24 of the threaded bottle stopper is coincident with the longitudinal axis of the tubular body portion and the longitudinal axis of the annular skirt 16.

A continuous mechanical thread 26 is provided on the inside surface of the annular skirt 16. The pitch of the continuous thread 26 is adapted for engagement with a corresponding pitch on an externally threaded bottle neck which is to be sealed by the bottle stopper 10.

Where the outside surface 28 of the tubular body portion 18 and the inside surface 30 of the annular skirt 16 meet the underside 20 of cap portion 14, an annular surface 32 is defined and constitutes the base of the annular space 22. Three concentric ribs 34 are provided on the annular surface 32 which contacts the rim of a bottle neck to be sealed by the threaded stopper. The function of the concentric sealing rings 34 will be discussed in more detail hereinafter with respect to FIGS. 2 and 3.

On the outside surface 28 of the tubular body portion 18, the aforementioned gas release means for controlling the release of pressurized gases from a bottle is provided. With the particular embodiment shown in FIG. 1, the gas release means comprises a single spiral ridge or thread 36 which leads from adjacent the bottom of, to adjacent the top of the tubular body portion and is integral with an annular sealing ring 38. Sealing ring 38 seals the bottle neck bore.

Figure 2:
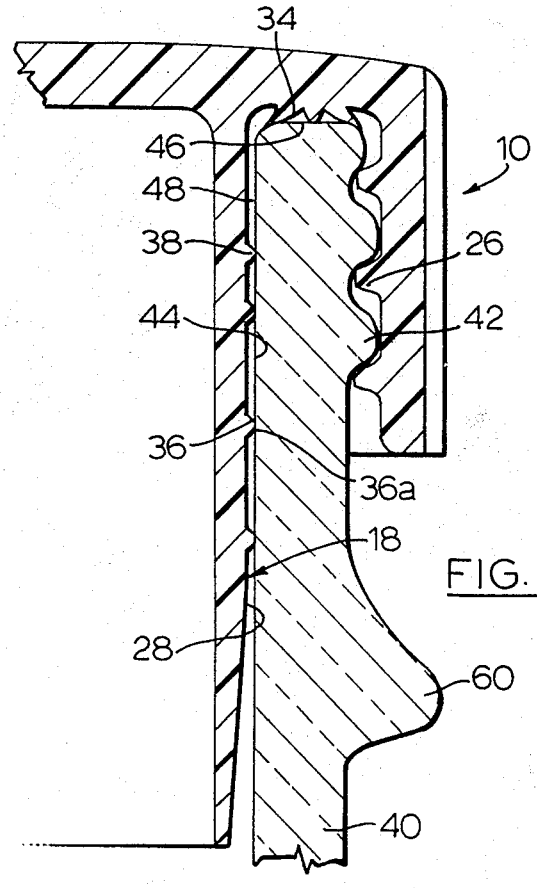
FIG. 2 shows a partial section of the bottle stopper shown in FIG. 1 which is in seated position as threaded on a bottle neck.

FIG. 2 shows the stopper 10 inserted in a bottle neck 40 which has a continuous right hand mechanical thread 42 on the outside surface thereof. As the bottle stopper 10 is threaded onto the bottle by rotation in a clockwise direction, the tubular body portion 18 is advanced into the neck bore 44 until concentric sealing rings 34 contact bottle rim 46, thereby sealing the discharge opening.

The outside surface 28 of the tubular body portion 18 has a diameter which is less than the diameter of the inside surface of the neck bore 44, thereby leaving a space 48 between the outside surface 28 and the inside surface of the neck bore 44. The single spiral thread 36 has a substantially constant thickness dimension equal to the width of space 48 so that the periphery **36*a* of the thread contacts the inside surface of the neck bore 44 in the manner shown in FIG. 2. The single spiral thread 36 therefore defines a spiral channel which leads from adjacent the bottom of, to adjacent the top of the tubular body portion 18. The spiral channel 50 is open-ended at the bottom, however, at the top it is closed by annular sealing ring 38 to prevent pressurized gases which are contained in bottle 40 from entering into space 48 above the annular sealing ring 38.**

Figure 3:
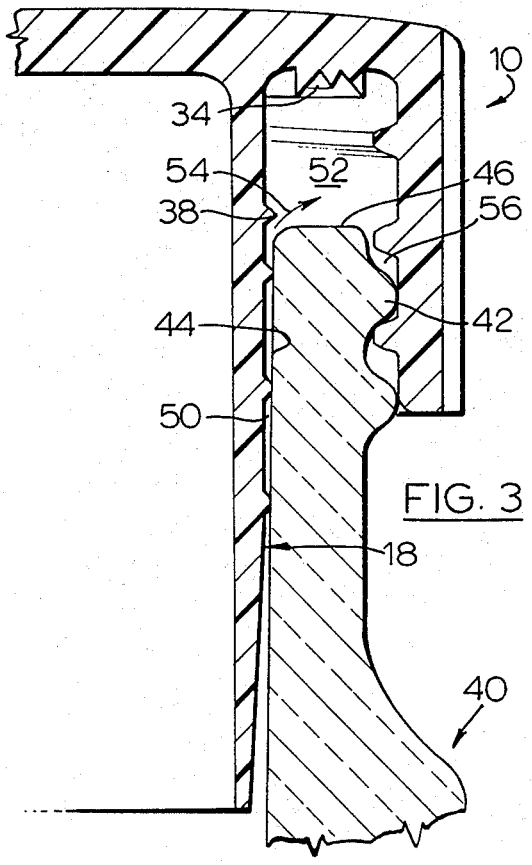
FIG. 3 shows a partial section of the bottle stopper shown in FIG. 1 in a position which permits a controlled release of pressurized gases from within the bottle to the atmosphere.

When the bottle stopper 10 is rotated in a counterclockwise direction the tubular body portion 18 is withdrawn from the neck bore 44 whereby the seals formed by concentric sealing rings 34 and annular sealing ring 38 are broken in the manner shown in FIG. 3. Annular sealing ring 38 is so positioned on tubular body portion 18 that its seal is broken prior to disengagement between threads 26 of the bottle stopper and threads 42 of the bottle. Channel 50 is now opened at both ends so that the channel is in communication with the inside of the bottle and with the atmosphere by way of a secondary channel 56 which is defined between the threads of the annular skirt and the bottle thread. Pressurized gases contained within bottle 40 are therefore permitted to pass through channel 50 to space 52 in the direction of arrow 54 and in turn released to the atmosphere through secondary channel 56.

As is usually experienced in opening a stoppered bottle of crackling, sparkling or champagne wine, the stopper is ejected from the bottle opening at a velocity which is dependent upon the temperature of and the contents of the bottle. For example, champagne wines are known to be stored in a bottle under pressures up to 6 atmospheres absolute. Such gaseous pressures can eject the stopper at very dangerous velocities. However, during the initial release of pressurized gases from the bottle in the manner shown in FIG. 3, the bottle stopper 10 is not ejected from the bottle opening because of the thread engagement between the bottle stopper and the bottle neck.

Although the preferred embodiment shown in FIG. 1 has concentric sealing rings 34 and an annular sealing ring 38, it is understood that the bottle stopper according to this invention would function in the desired manner in the absence of either the annular sealing ring 38 or the concentric sealing rings 34 so long as the sealing means seals the discharge opening of the bottle when the bottle stopper is engaged with the bottle neck threads 42 and also that the seal is broken prior to disengagement between the threads of the bottle stopper and the bottle neck.

As shown in FIG. 1 of the drawings, the tubular body portion 18 extends downwardly beyond the lower edge 13 of the cap 12. However, it is understood that with the wide variety of bottles available on the market, the bottle stopper 10 may be of an alternate design, such as the tubular body portion 18 not extending beyond the lower edge 13 of cap 12, providing the initial release of pressurized gases from the bottle is controlled in the aforementioned manner according to this invention.

In accordance with an object of the invention, it is desirable to control the initial release of pressurized gases from the bottle subsequent to disengagement of the threads 26 with the threaded bottle neck where upon a complete withdrawal of the bottle stopper, the familiar and desirable "pop" sound is heard. The controlled release of pressurized gases from the bottle 40 during initial release thereof is regulated by selecting an outside diameter of the tubular body portion such that the channel 50 is of a limited cross-sectional area. Due to the spiralling of the channel, the pressurized gases have to follow a tortuous path before escaping to the atmosphere. By this continual re-directing of the flow of the gases a controlled slow release of the pressurized gases is realized. Eventually the pressurized gases held within the bottle will equalize with the atmosphere in this manner however, by selecting an appropriate cross-sectional area for the channel 50, the release of pressurized gases can be regulated so that after the initial release of gases, a portion of pressurized gas remains in the bottle to give the desirable "pop" sound when the stopper is completely removed from the bottle. The "pop" sound is, of course, only evident if the gases in the bottle are still under pressure. On the other hand, the pressurized gases should be permitted to flow through channel 50 at a sufficient rate so that the portion of pressurized gases remaining in the bottle is not at high enough pressure to eject the bottle stopper 10 at a dangerous velocity when the threads of the bottle stopper are disengaged from the threaded bottle.

As discussed hereinabove, it is difficult to hold close tolerances on the neck bore dimensions of the bottle. However, in forming the bottle stopper 10 by injection molding of a thermoplastic resin having suitable memory properties, a slightly oversized tubular body portion 18 may be used whereby frictional engagement of the annular sealing ring 38 with the neck bore 44 is ensured to properly seal the neck bore 44. In such an instance, concentric sealing rings 34 are only required as a precautionary measure. The increased frictional forces between the stopper and the bottle in using an oversized tubular body portion 18 are easily overcome in opening the bottle since the continuous thread 26 on the annular skirt 16 provides a mechanical assist in overcoming the frictional forces to withdraw the tubular body portion 18 from the neck bore 44. Serrations 58 may be provided on the outside surface of the annular skirt 16 to ensure an adequate grip on the cap to facilitate rotation thereof.

A shoulder 60 is provided on the bottle neck to permit the use of a wire cage for the stopper to provide the necessary aesthetic appeal to the consumer. However, the wire cage is of no great value because the threaded annular skirt serves to retain the annular body portion 18 within the bore neck 44 of the bottle.

Figure 4:
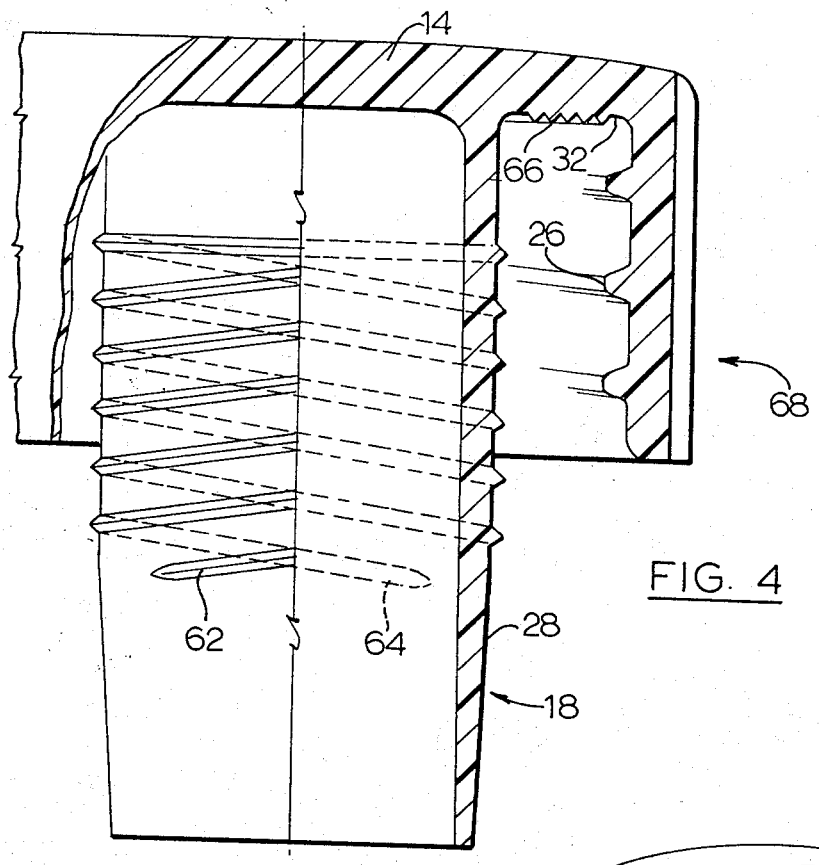
FIG. 4 is a partially sectioned side view of another preferred embodiment according to the invention showing alternate gas release control means.
Figure 5:
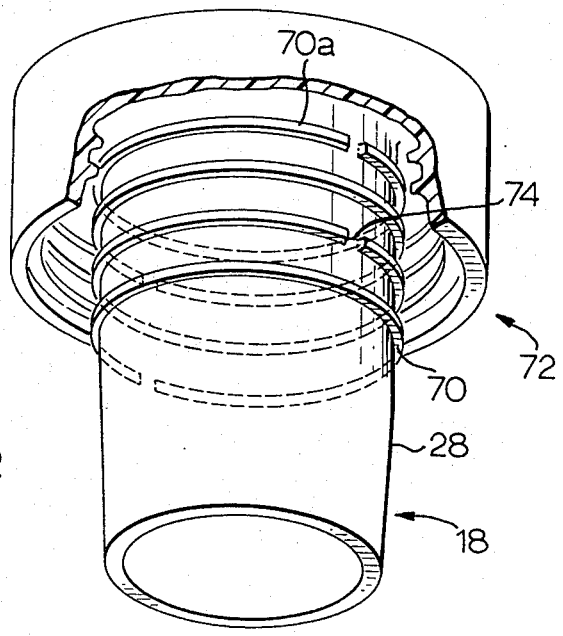
FIG. 5 shows a side view of yet another preferred embodiment according to the invention having alternate gas control release means.

Alternative arrangements for providing a tortuous channel through which the gases must pass during initial release of pressurized gases from the bottle, are shown in FIGS. 4 and 5. In FIG. 4 symmetrical double helical threads 62 and 64 are provided on the outside surface 28 of the tubular body portion 18. The double threads lead upwardly from adjacent the bottom of, to adjacent the top of the tubular body portion and are integral with the annular sealing ring 38. Double threads 62 and 64 form two spiral channels which are defined between the periphery of the tubular body portion 18 and the inside surface of the bottle neck bore. The channels are open at the bottom thereof through which pressurized gases contained within a bottle pass in escaping to the atmosphere in a similar manner to that shown in FIG. 3.

An alternate form of a concentric sealing ring arrangement 66 is provided on the annular surface 32 of the disc portion 14. The sealing rings 66 engage the rim of a bottle onto which the stopper 68 is threadably engaged. The arrangement of the annular sealing ring 38 on the tubular body portion 18 on stopper 68 is located in the same position as the annular sealing ring 38 of the stopper 10 so as to open the spiral channels defined by spiral threads 62 and 64 to permit communication of the channels with the atmosphere prior to disengagement between the threads 26 and the threads of the threaded bottle neck.

Another arrangement for providing a tortuous path through which pressurized gases pass in escaping to the atmosphere in accordance with the invention is shown in FIG. 5 where a plurality of spaced-apart concentric rings 70 are provided on the outside surface 28 of the tubular body portion of the threaded stopper 72. Each ring has a discontinuity 74 in its thickness to define an aperture between the outside surface 28 of the tubular body portion 18 and the inside surface of the neck bore of the bottle which the threaded bottle stopper 72 engages. Each of the discontinuities in thickness of each ring is located at a different circumferential location than the location of the discontinuity in adjacent rings, thereby defining a tortuous path through which the pressurized gases pass upon release to the atmosphere in a similar manner to that shown in FIG. 3. As shown, the upper ring **70*a* is provided with a discontinuity in its thickness 74 where the seal of the discharge opening of the bottle would be achieved by concentric sealing rings such as those shown in FIGS. 4 and 1 which engage the rim of the bottle to be sealed. On the other hand, an annular sealing ring may be provided above concentric ring 70*a*** to provide the desired sealing of the neck bore of the bottle.

The bottle stopper according to this invention may be inserted in the neck bore of a bottle in accordance with standard bottle corking procedures where the stopper is twisted to threadably engage the threaded bottle neck. With the various alternate arrangements of ridges on the outside surface of the tubular body portion of the threaded bottle stopper according to this invention, the spiral threads as shown in FIGS. 1 and 4 assist in the introduction of the tubular body portion of the stopper into the neck bore of the bottle during rotation thereof. In particular, the symmetrical double threads 62 and 64 of bottle stopper 68 assist in the initial insertion of the tubular body portion into the neck bore of a bottle by aligning the longitudinal axis of the bottle stopper with the longitudinal axis of the bottle because the lower portion of each thread 62 and 64 lie in a common plane which is perpendicular to the longitudinal axis of the stopper.

While various embodiments of the invention have been discussed herein in detail, it is understood that variations may be made by those skilled in the art without departing from the spirit of the invention or the scope of the appended claims.

The embodiments of the invention in which an exclusive property or privilege is claimed are defined as follows:

1. A threaded bottle stopper for engaging an externally threaded bottle neck to provide a controlled release of pressurized gases from a bottle, comprising: a cap having a disc portion with an annular skirt depending downwardly therefrom; a tubular body portion extending downwardly from and integral with the underside of said disc portion, the outside diameter of said tubular body portion being less than the inside diameter of said annular skirt where the longitudinal axis of said tubular body portion is coincident with the longitudinal axis of said annular skirt; an annular space being defined between the outside surface of said tubular body portion and the inside surface of said annular skirt; a continuous thread on the inside surface of said annular skirt; the outside diameter of said tubular body portion being such to permit insertion of said tubular body portion in a bottle neck bore; said continuous thread on said annular skirt adapted to engage a continuous external thread on a neck of a bottle whereby rotation of said threaded bottle stopper about its longitudinal axis in both directions moves said tubular body portion respectively into and out of the neck bore of the bottle; said bottle stopper having means for sealing the discharge opening of the bottle neck; said tubular body portion having gas release means on the outside surface thereof for controlling the release of pressurized gases from a bottle by providing at least one open-ended tortuous channel through which the pressurized gases pass before escaping to the atmosphere; said gas release means releasing pressurized gases from the bottle while said continuous thread on said annular skirt engages the external thread of the externally threaded bottle neck and subsequent to a breaking of said means for sealing the discharge opening of the bottle neck upon rotation of said threaded bottle stopper in the respective direction.

2. A threaded bottle stopper of claim 1 wherein said gas release means comprises at least one ridge located on the outside surface of said tubular body portion, said at least one ridge having a substantially constant thickness dimension so that the periphery of said at least one ridge slidably contacts a bottle neck bore surface when said tubular body portion is inserted within a bottle neck bore, said at least one ridge being so arranged on the outside surface of said tubular body portion to define said at least one open-ended tortuous channel between the outside surface of said tubular body portion and the inside surface of a bottle neck bore.

3. A threaded bottle stopper of claim 2 wherein a ridge is so arranged to define an open-ended spiral channel between said outside surface of said tubular body portion and a bottle neck bore surface, said ridge being a single thread leading from adjacent the bottom of, to adjacent the top of said tubular body portion.

4. A threaded bottle stopper of claim 3 wherein said means for sealing the discharge opening of the bottle neck comprises an annular sealing ring disposed adjacent the top of and concentric with said tubular body portion, said annular sealing ring having a substantially constant thickness dimension so that the entire periphery of said annular sealing ring contacts a bottle neck bore surface; said annular sealing ring being so positioned on said tubular body portion that a sealing of a bottle neck bore by the annular sealing ring is broken prior to disengagement between said continuous thread on said annular skirt and a continuous thread of an externally threaded bottle neck when said bottle stopper is rotated in the respective direction.

5. A threaded bottle stopper of claim 3 wherein said bottle stopper is formed from a thermoplastic resin having memory to permit a compression fit between said ridge and a bottle neck bore surface.

6. A threaded bottle stopper of claim 2 wherein two spaced apart ridges are so arranged to define two independent open-ended spiral channels between said outside surfaces of said tubular body portion and a bottle neck bore surface, said two ridges being a symmetrical double thread leading from adjacent the bottom of to adjacent the top of said tubular body portion.

7. A threaded bottle stopper of claim 2 wherein at least two ridges are so arranged to constitute a plurality of spaced-apart concentric rings on said outside surface of said tubular body portion, each ring having at least one discontinuity in its thickness to define at least one aperture between said outside surface of said tubular body portion and a bottle neck bore surface, each aperture being located at a different circumferential location than the location of the apertures in adjacent rings; said pressurized gases passing through said apertures before escaping to the atmosphere.

8. A threaded bottle stopper of claim 1 wherein said tubular body portion extends downwardly beyond the lower edge of said annular skirt; said tubular body portion being adapted to remain within a bottle neck bore subsequent to disengagement between said continuous thread of said annular skirt and the continuous thread of the externally threaded bottle neck.

9. A threaded bottle stopper of claim 8 wherein an annular surface on the underside of said disc portion of said cap is defined between the outside surface of said tubular body portion and the inside surface of said annular skirt where the respective surfaces meet the underside of said disc portion.

10. A threaded bottle stopper of claim 9 wherein said means for sealing a discharge opening of a bottle neck comprises a plurality of spaced-apart concentric sealing rings positioned on said annular surface; said plurality of concentric sealing rings contacting a rim of a discharge opening of a bottle to sealingly engage a bottle rim when the bottle stopper is rotated in the respective direction to seat said plurality of sealing rings against a bottle rim.

11. A threaded bottle stopper of claim 10 wherein second means for sealing a discharge opening of a bottle neck bore is provided on the outside surface of said tubular body portion and comprises an annular sealing ring disposed adjacent the top of and concentric with said tubular body portion; said annular sealing ring having a substantially constant thickness dimension so that the entire periphery of said annular sealing ring contacts a bottle neck bore surface; said annular sealing ring being so positioned on said tubular body portion that a double sealing of a discharge opening of a bottle neck by said concentric sealing rings and said annular sealing ring is broken prior to disengagement between said continuous thread on said annular skirt and a continuous thread of an externally threaded bottle neck when said bottle stopper is rotated in the respective direction.

12. A threaded bottle stopper of claim 11 wherein said annular sealing ring is so positioned on said tubular body portion that a sealing of the discharge opening of the bottle neck by said concentric sealing rings is broken prior to a breaking of a sealing of the discharge opening by said annular sealing ring.

13. A threaded bottle stopper of claim 11 wherein said gas release means comprises at least one ridge located on the outside surface of said tubular body portion, said at least one ridge having a substantially constant thickness dimension so that the periphery of said at least one ridge slidably contacts a bottle neck bore surface when said tubular body portion is inserted within a bottle neck bore, said at least one ridge being so arranged on the outside surface of said tubular body portion to define said at least one open-ended tortuous channel between the outside surface of said tubular body portion and a bottle neck bore surface.

14. A threaded bottle stopper of claim 13 wherein a ridge is so arranged to define an open-ended spiral channel between said outside surface of said tubular body portion and a bottle surface, said ridge being a single thread leading from adjacent the bottom of, to adjacent the top of said tubular body portion.

15. A threaded bottle stopper of claim 14 wherein said bottle stopper is formed from a thermoplastic resin having memory to permit a compression fit between said ridge and a bottle neck bore surface.

16. A threaded bottle stopper of claim 13 wherein two spaced-apart ridges are so arranged to define two independent open-ended spiral channels between said outside surface of said tubular body portion and a bottle neck bore surface, said two ridges being a symmetrical double thread leading from adjacent the bottom of, to adjacent the top of said tubular body portion.

17. A threaded bottle stopper of claim 13 wherein at least two ridges are so arranged to define a plurality of spaced-apart concentric rings on said outside surface of said tubular body portion, each ring having at least one discontinuity in its thickness to define at least one aperture between said outside surface of said tubular body portion and a bottle neck bore surface, each aperture being located at a different circumferential location than the location of apertures in adjacent rings; said pressurized gases passing through said apertures before escaping to the atmosphere.

* * * * *